US005078279A

United States Patent [19]

Hancock et al.

[11] Patent Number: 5,078,279

[45] Date of Patent: Jan. 7, 1992

[54] GUN RACK

[76] Inventors: Dennis Hancock, 1001 W. Cedar Knolls S., Cedar City, Utah 84720; George Gates, 2286 Bonanza Cir., South Jordan, Utah 84065

[21] Appl. No.: 702,179

[22] Filed: May 20, 1991

Related U.S. Application Data

[63] Continuation of Ser. No. 502,750, Apr. 2, 1990, abandoned.

[51] Int. Cl.[5] ..... A47F 7/00

[52] U.S. Cl. ..... 211/64; 211/70.5

[58] Field of Search ..... 211/64, 87, 89, 60.1, 211/70.5; 248/223.1, 221.3, 222.4, 222.1

[56] References Cited

U.S. PATENT DOCUMENTS

| | | | |
|---|---|---|---|
| 2,708,088 | 5/1955 | Steinbe | 248/223.1 |
| 3,701,436 | 10/1972 | Adams | 211/70.5 |
| 3,876,079 | 4/1975 | Elkins et al. | 211/64 |
| 4,084,735 | 4/1978 | Kappas | 211/70.5 X |
| 4,108,313 | 8/1978 | Bogar, Jr. | 211/64 |
| 4,271,997 | 6/1981 | Michael | 211/70.5 X |
| 4,450,989 | 5/1984 | Bogar, Jr. | 211/64 X |
| 4,776,471 | 10/1988 | Elkins | 211/64 |

*Primary Examiner*—Reinaldo P. Machado
*Assistant Examiner*—Sarah A. Lechok
*Attorney, Agent, or Firm*—Thorpe, North & Western

[57] ABSTRACT

A utility holding device attachable to a vertical surface for carrying elongated objects such as rifles, bows, fishing rods and the like. The device can be attached to a vertical surface such as a wall or a window, and is specifically intended to be used on the interior surface of a vehicle such as a truck or boat. The device includes a base unit which is permanently attached either by adhesive or screws to the vertical surface. The base unit includes the female portion of an attachment member. The device further includes a mounting stem which includes the male portion of the attachment member and which also includes either a large holding unit integrally formed therewith or adjustably attachable thereto. The female and male portions of the attachment member being interlockable to rigidly attach the stem and base unit. The holding unit may also include a hold-down member which can encircle an item such as a rifle to prevent its removal therefrom.

9 Claims, 5 Drawing Sheets

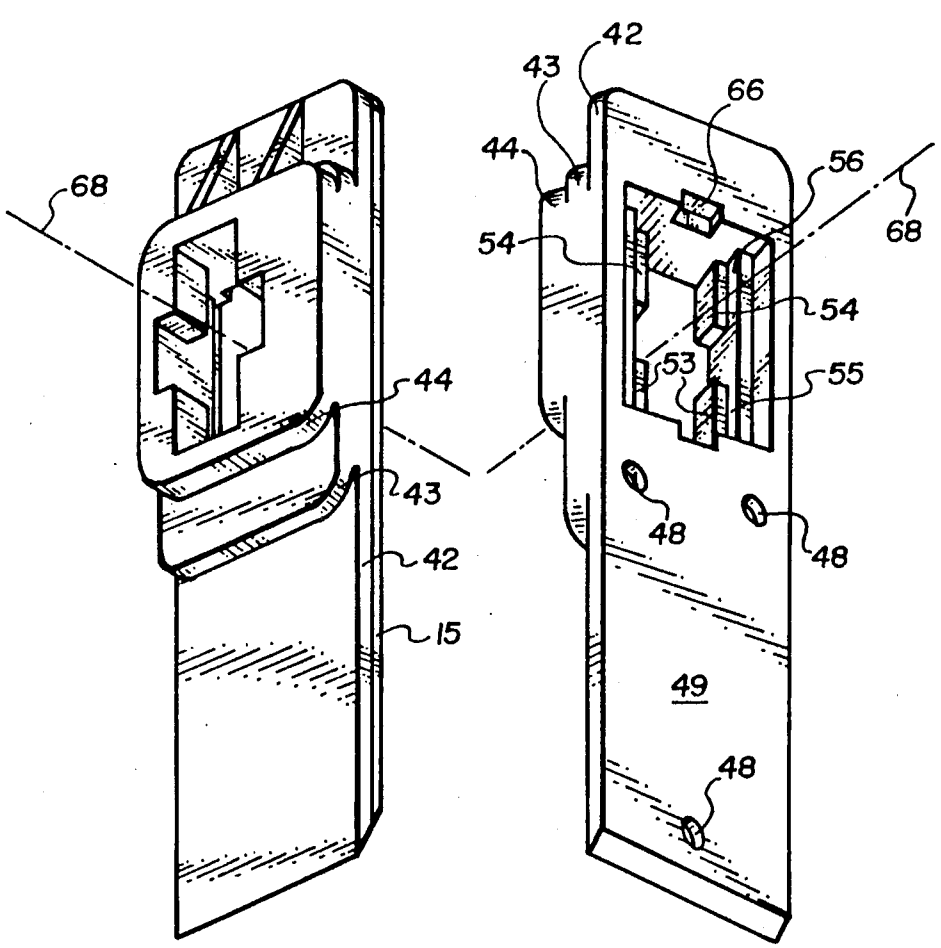
Fig. 3(b)
Fig. 3(a)
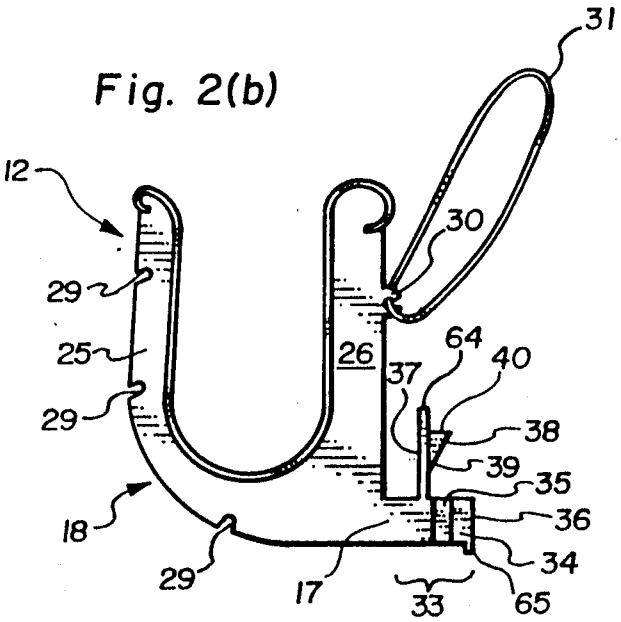
Fig. 2(b)
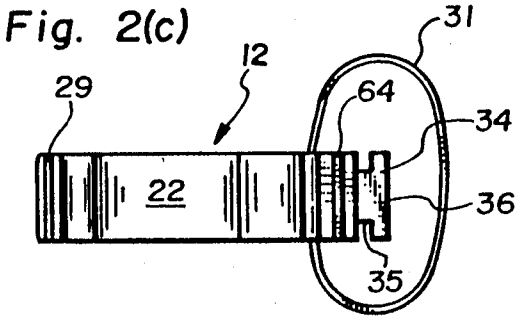
Fig. 2(c)

GUN RACK

BACKGROUND OF THE INVENTION

Field of the Invention

The present invention relates to a utility carrier for attachment to a vertical surface such as a wall or a window. More specifically, the present invention pertains to a utility carrier of modular design which allows for flexibility in arrangement and orientation of the modular units which make up the carrier to allow it to hold a wide variety of sizes and shapes of elongated objects in a fixed and stable position adjacent to a vertical surface on which the carrier is mounted.

It is becoming increasingly common to use racks or other similar devices to store or display objects of an elongated shape. Specifically, in the confines of a vehicle it has become increasingly useful to attach a rack on a vertical surface such as a wall or window of the vehicle to store and display items of elongated shape. An example of this is the need for storing items such as a rifle, bow, fishing rod, baseball bat, long tool, etc. in the relative small confines of a truck cab or boat. Racks have been heretofore placed in truck cabs, being conventionally located on the interior side of the rear wall of the cab.

Prior art attempts to mount a rack or other type carrier to a vertical wall such as the interior wall of a truck cab have failed to provide the versatility required for a general utility-type carrying device. For example, a fully functional carrier must be adjustable to securely hold a variety of shapes and sizes of elongated objects without the attendant risk of inadvertent release from this adjusted position. Also, a carrier for attachment to a vertical surface such as in a truck cab or boat, is most advantageously comprised of small modular units which can be individually placed to avoid irregularity in the vertical surface and to conform to space limitations. For example, base units which in combination form the basis for the utility carrier must be mountable individually so as to be able to conform the carrier to the confines of a window such as a slidable rear window in a cab or a small vertical surface in the interior of a boat.

Further, because trucks, boats and similar vehicles are generally subjected to vibrations which can easily loosen or cause to be detached any carrier device, or object placed therein, from the vehicle wall or window, each modular unit of the carrier must be rigidly lockable to other components to prevent unexpected disassembly caused by movement of the vehicle.

Prior art modular mounting devices are typified by U.S. Pat. No. 4,025,015 to Kolic. Kolic shows a first modular unit which is attachable by adhesive to the surface to which the device is to be mounted, and a second modular unit which holds objects to be mounted on the device. The first and second modular units are engageable by a simple plug and socket type engagement. The plug and socket engagement is easily separated and includes no means for locking the unit together to prevent inadvertent detachment.

Norrington, U.S. Pat. No. 3,294,247 shows an adjustable rifle rack. Norrington's device cannot be attached directly to a vehicle window and the clamping units are not easily adjustable (cannot be adjusted by hand) to adapt the device to a particular size and shape of an object to be stored therein. Further, the clamp unit of Norrington's device cannot be removed entirely from the mounting bars thereof when the device is not in use (the mounting bars are interattached only by means of the clamp units attached thereto).

SUMMARY OF THE INVENTION

It is an object of the present invention to provide a utility carrier in which elongated objects can be laid and securely retained in place.

It is further an object of the present invention to provide a utility carrier which is modular in design allowing for flexibility in mounting and use thereof.

It is another object of the present invention to provide a utility carrier having modular base unit type mounting brackets which can be individually mounted.

It is further an object of the present invention to provide a utility carrier having modular units which can be quickly and easily locked together and also quickly and easily unlocked and detached from each other.

These and other objects are realized in a utility carrier for attachment to a vertical surface such as a wall or window which includes a plurality of modular units which combine to form the carrier including: (1) a base unit of generally rectangular configuration having a flat back surface which is attachable to a wall or window by means of adhesive, screws, nails or the like, the attachment unit also having a front surface through which a cross-shaped opening passes, the cross-shaped opening comprising and partially forming a female portion of an attachment member, the female portion of the attachment member including a pair of shoulder-and-groove type attachment elements arranged in mirror image relationship; (2) a stem unit, including on a first end thereof, a male portion of the attachment member, the male portion of the attachment member including head-and-slot type attachment elements, the head being sized so as to pass through the cross-shaped opening into the grooves of the female portion of the connector and then slidable downwardly to engage the shoulders of the female portion with the slots of the male portion of the attachment member to thereby hold the head in the grooves, a tab attached to the stem directly behind the male portion of the attachment member extends from the stem in a direction normal to the male portion and includes thereon a secondary locking shoulder which, when the male and female locking portions are engaged, locks in place in the cross-shaped opening to prevent inadvertent disengagement of the male and female portions; and (3) the end of the stem opposite the male locking member is formed into a generally U-shaped holding unit. The interior of the holding unit being lined with a padding material and the exterior thereof having included thereon a series of notches which operate in conjunction with a tie-down member which can be drawn across the opening of the U-shaped member to the opposite side thereof to be engaged in one of the notches to secure an object from inadvertent displacement or dislodging from the holding unit.

An alternative embodiment of the present invention includes a platform on the end of the stem opposite the male locking portion which includes a threaded opening. This threaded opening will accept a holding unit such as is shown and defined in applicant's U.S. Pat. No. 4,607,772, the entire disclosure of which is incorporated herein by reference.

BRIEF DESCRIPTION OF THE DRAWINGS

Other objects and features of the present invention will become apparent to those skilled in the art based upon the following detailed description, taken in connection with the accompanying drawings in which similar numerals are used to describe similar features in each drawing, the drawings being described as follows:

FIG. 2(*b*) is a side view of the stem and holding unit of the present invention;

FIG. 3(*b*) is a rear perspective view of the base unit of the present invention;

FIG. 3(*c*) is a front view of the base unit of the present invention;

FIG. 3(*d*) is a rear view of the base unit of the present invention;

FIG. 3(*e*) is a cross-sectional view of the base unit of the present invention taken along line II—II of FIG. 2(*c*);

FIG. 3(*f*) is a side perspective view of a portion of two base units of the present invention;

FIG. 4(*b*) is a side view of the stem unit of the FIG. 4(*a*);

FIG. 4(*c*) is a rear view of the stem unit of FIG. 4(*a*);

DETAILED DESCRIPTION OF THE INVENTION

Figure 1:
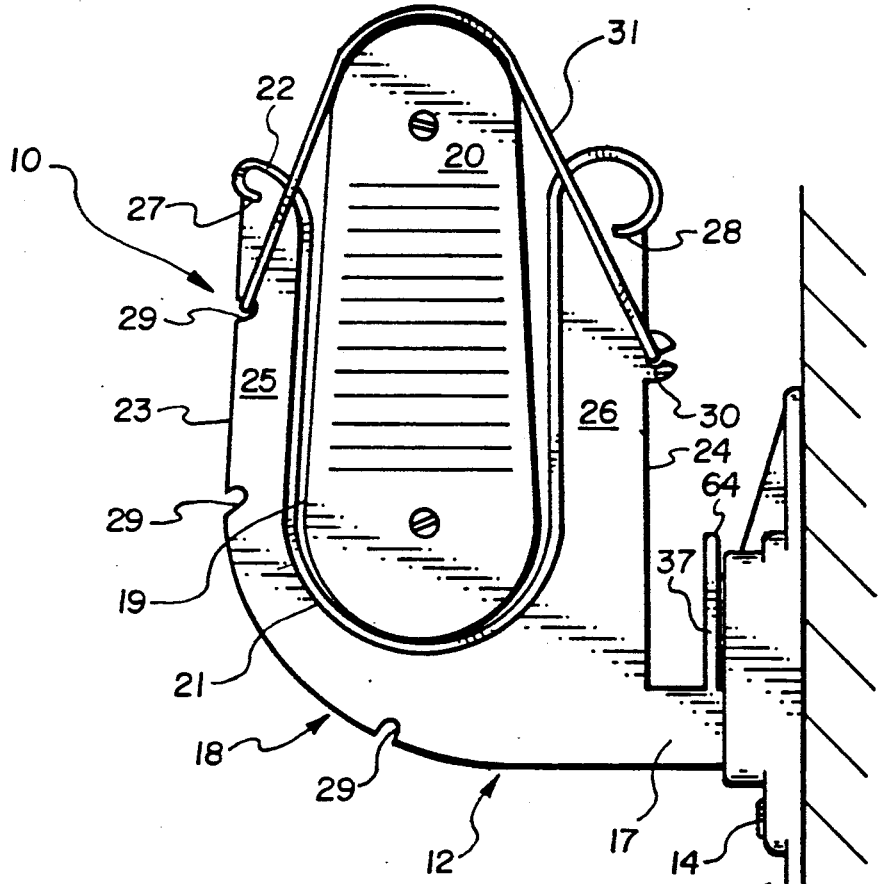
FIG. 1 is a side view of one embodiment of the present invention attached to a wall and having an object included in its holding unit.

FIG. 1 shows a preferred embodiment of a sub assembly 10 of the utility carrier of the present invention. The sub assembly 10 may be used individually, or more preferably, used in conjunction with one or more other sub assemblies to build a complete system of sub assemblies 10 which can work together to hold any number of elongated objects.

Although the utility carrier of the present invention may include several sub assemblies 10 which work in conjunction, the invention will be described as a single sub assembly 10 throughout the specification wherever such will contribute to a clear and concise explanation of the invention.

The sub assembly-type design of the present invention significantly increases its versatility by allowing the end user to rotate and orient each sub assembly 10 in accordance with his or her own needs. Because of the modular characteristics of the sub assembly-type design of the present invention, it can be adapted for use in many areas and for many purposes which the prior art was not capable of.

The sub assembly 10 as shown in FIG. 1, includes a base unit 11 and a holding unit 12. The base unit 11 is securable to a wall 13 by means of screws or bolts 14. Alternatively, of course, the base unit 11 may be attached by means of double-sided adhesive strippings 15, or the like, and may be applied to other vertical surfaces such as a window 16. Although only screws or bolts 14 and adhesive strippings 15 are shown, it is contemplated that the base unit 11 be attachable to any surface by any well-known fastening means.

The holding unit 12 is removably attachable to the base unit 11 through a stem 17 in a manner which will be explained below. The holding unit includes a generally U-shaped holding member 18. The U-shaped holding member 18 forms a U-shaped opening 19 sized so as to snugly hold the stock 20 of a rifle. It is of course anticipated that any size U-shaped opening 19 be utilized in the present invention a specifically, a U-shaped opening 19 sized so as to snugly hold a fishing rod, bow, etc.

The interior surface 21 of the U-shaped holding member 18 is preferably lined with a cushion or pad 22 which will be nonabrasive to any object placed in the holding unit 12. The pad 22 is secured to the outer surfaces 23 and 24 of inner and outer arm portions (25 and 26, respectively) of the U-shaped member 18, by insertion of each end thereof into slots 27 and 28. The slots 27 and 28 and interior surface 21 may work in conjunction with an adhesive (not shown) to securely hold the pad in its proper position on the holding unit 12.

The exterior surface 23 of outer arm 25 of the U-shaped holding member 18 can include a series of horizontally-formed U-shaped notches 29 formed at a plurality of locations therealong. The exterior surface 24 of inner arm portion 26 of the U-shaped holding member 18 can also include an anchor 30 into which is inserted a hold down 31, the hold down 31 being preferably formed as a continuous flexible loop of stretchable material.

When an object is placed in the U-shaped opening 19 of the holding unit 12, the hold down 31 can be stretched from its anchor 30 over the top of the object and secured in the most convenient notch 29 on the outer arm portion 25. The hold down 31 thus functions to secure the object in the holding unit 12 and prevent any vibrations or movement of the object or the sub assembly 10 (such as can be caused if the carrier is mounted in a vehicle or boat) from inadvertently dislodging the object therefrom.

The holding unit 12 can be made of any material such as wood, metal or plastic, and may be formed of a sufficient amount of material to give it sufficient strength and rigidity to hold and immobilize any elongated object placeable therein. The cushion may be formed of any soft, pliable material such as foam rubber, leather, wool, animal hides or fur, or imitations thereof. The holding unit 12 is connectable to the base unit 11 by a male-female type attachment member 32.

Figure 2A:
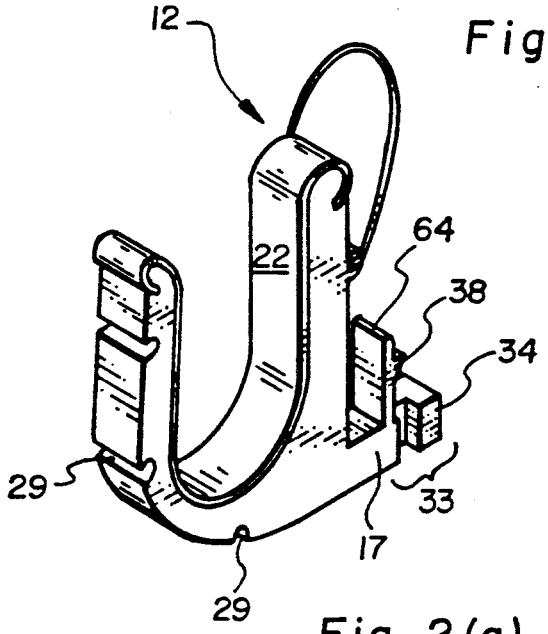
FIG. 2(*a*) is a perspective view of the stem and holding unit of the present invention.
FIG. 2(c) is a top view of the stem and holding unit of the present invention.

As seen in FIGS. 2 (*a–c*), the stem 17 connects the holding unit 12 to the male portion 33 of the attachment member 32. One end of the stem 17 is integrally formed with the holding unit 12 and the opposite end being formed into the male portion 33.

The stem 17 extends away from the holding unit 12 in a direction which is generally perpendicular to the arms 25 and 26 of the U-shaped holding member 18. The end of the stem 17 forms the male portion 33 of the attachment member 32 forming a head 34. The pair of slots 35 are formed just behind the head and are also formed so as to be oriented in a direction generally parallel to the arms 25 and 26 of the holding unit 12. The head 34 preferably includes a catch 35 formed in the face 36 thereof which extends away from the head 34 in a direction opposite to, and parallel with, the arm 25 and 26 of the holding unit 12.

A tab 37 is attached to the stem 12 at a position adjacent to the slots 35, between the holding unit 12 and the male portion 33 of the attachment member 32. The tab 37 extends from its attachment with the stem 17 in a direction parallel to the arms 25 and 26 of the holding unit 12. The tab 37 has included thereon a locking shoulder 38 which forms a locking surface 39 and a ramp 40. The locking shoulder 38 extends from the tab 37 in the direction of the male portion 33 of the attachment member 32. The tab 37 and locking shoulder 38 function to lock the male and female portions (33 and 41 respectively) of the attachment member 32 in their attached position in a manner as will be explained below.

Figures 3C, 3D, 3E, 3F:
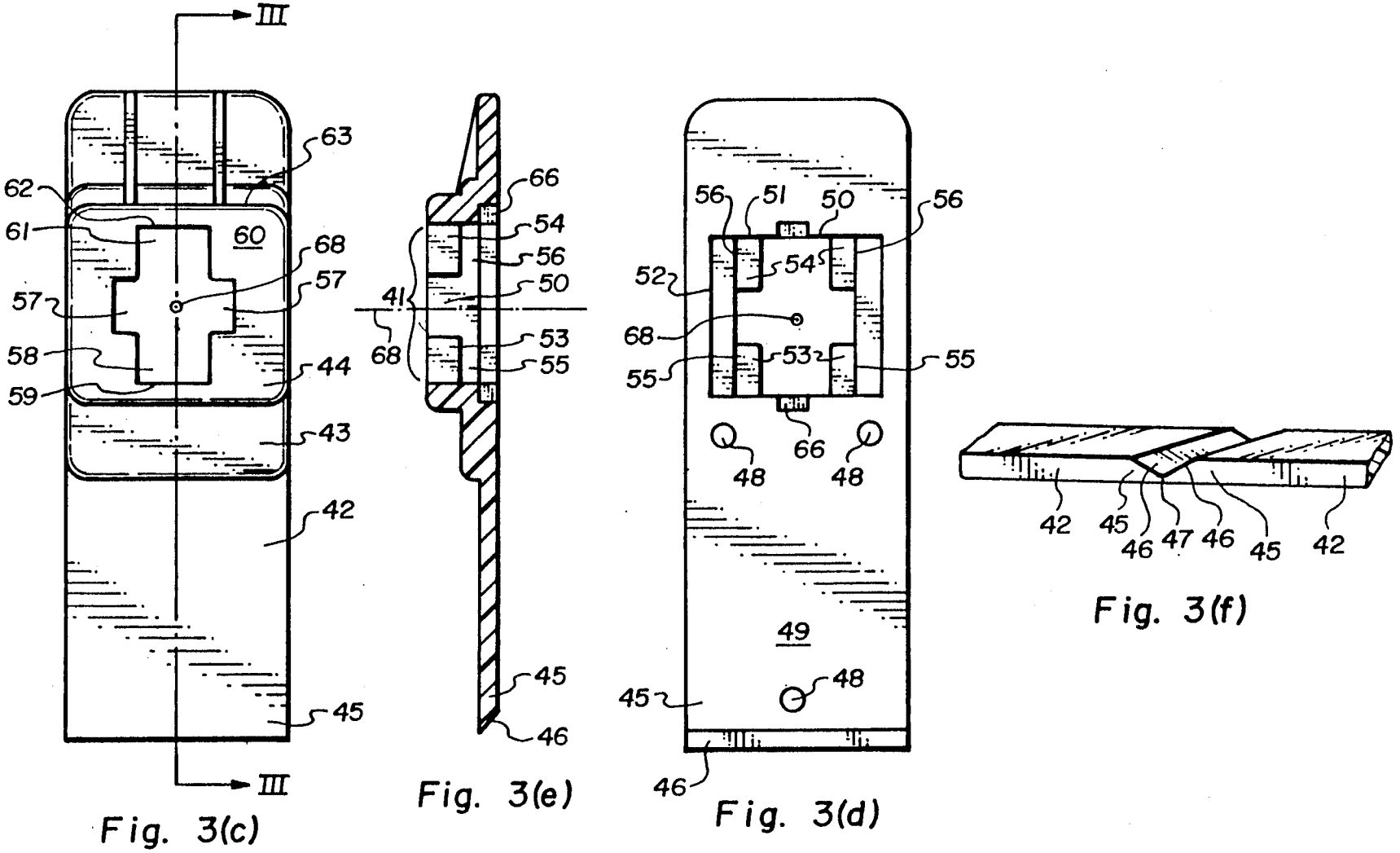
FIG. 3(*a*) is a front prospective view of the attachment unit of the present invention.

The female portion 41 of the attachment member 32 is formed integrally with the base unit 12. As best seen in FIGS. 3(*a–e*), the base unit 12 is formed of a three-tiered, generally rectangular shape of metal, wood, or plastic material. The lower tier 42 is of generally rectangular shape, and has a generally rectangularly-shaped middle tier 43 located slightly off-center thereof. The middle tier 43 is of approximately one-third the length of the lower tier 42. The generally rectangular upper tier 44 is slightly smaller than the middle tier 43 and is located on the middle tier 43 at a point slightly off-center thereof.

A distal end 45 of the lower tier 42 of the base unit 11 is formed into a beveled edge 46. As can be seen in FIG. 3(*f*), the beveled edge 66 of the base unit 11 can be formed integrally with a beveled edge 46 of a second base unit 11. In this configuration, a user can, if desired, mount both base units 11 as one integrally formed unit. If, however, the user desires to mount the base units 11 separately, he or she can easily break the connection 47 between the two base units 11 before mounting.

The lower and middle tiers 42 and 43 of the base unit 11 can include openings 48 through which screws, nails, bolts or the like may be passed to attach the base unit 11 to a wall or other vertical surface. Alternatively, the back surface 49 of the lower tier 42 may be covered with an adhesive material 15, such as a two-sided adhesive strip, which would function to attach the base unit 11 to a wall in a well-known manner.

The female portion 41 of the attachment member 32 is formed as a contiguous set of openings in the upper, middle and lower tiers (42, 43 and 44, respectively) of the base unit 11. A cross-shaped opening 50 is located in the upper tier 44 and extends completely therethrough. The middle tier 43 includes a generally rectangular-shaped opening 51 which is contiguous with cross-shaped opening 50 and of the same length and width as the longest and widest portions thereof. Opening 51 is located directly beneath cross-shaped opening 50. The lower tier 42 includes a rectangular-shaped opening 52. The opening 52 is contiguous with openings 50 and 51 and is somewhat larger in its width than the opening 51 but of the same length. Opening 52 is located directly beneath the middle tier opening 51.

The shoulders 53 and 54, generated by the cross-shaped opening 50 of the upper tier 44, cooperate with the rectangular-shaped opening 51 of the middle tier 43 to form a groove or cutaway areas 55 and 56 behind each of the shoulders 53 and 54 respectively. The rectangular-shaped opening 52 of the lower tier 42 functions as a recess area which is needed to displace the shoulder and groove or cutaway areas (53 and 54) away from the back surface 49 of the lower tier 42. This is necessary to allow sufficient clearance between the face 36 of the male portion 33 and the wall 13 or window 16 to which the base unit 11 is attached, when the male portion 33 and the female portion 41 of the attachment member 32 are interconnected.

Although the female portion 41 of the attachment member 32 has been described as a contiguous set of openings in upper, middle, and lower tiers of the base unit 11, it has been described in this manner only to simplify the explanation of the various elements and workings of the female portion 41. And, although the base unit may be constructed from three separate sheets or tiers of material formed with the above-described openings therein and then fixed together such as by adhesive or the like in the above-described orientation, it is also contemplated that the entire base unit 11 be molded as a single integral unit. Further, although the base unit 11 has been described as being generally rectangular in shape, it is contemplated that the base unit may be formed in any desired shape so long as it will accommodate the female portion 41 of the attachment member 32 as described above, and remains capable of being rigidly fixed to a vertical surface.

Figure 5:
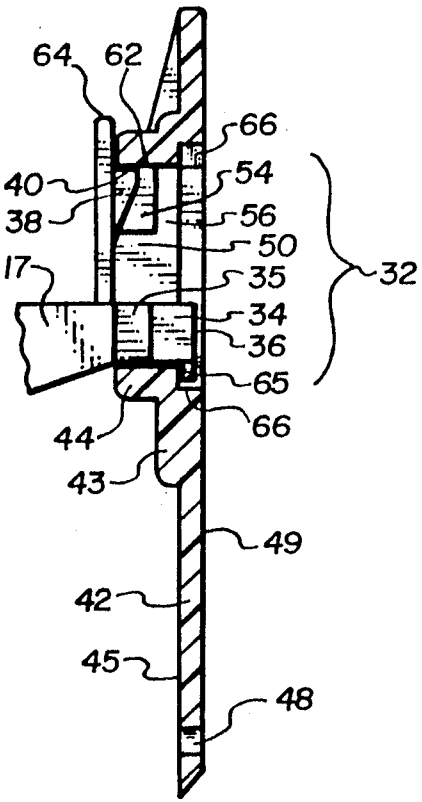
FIG. 5 is a partial cross-sectional view of the base unit with the stem unit attached thereto (only the attachment unit being shown in cross-section)

FIG. 5 shows the base unit in cross-section with the stem portion of a holding unit shown in side view and the male and female portions of the attachment member shown in their interconnected and locked position. To achieve this locked position from a position where the male and female portions 33 and 41 of the attachment member 32 are disconnected, the stem 17 is first held so that the face 36 of the head 34 of the male portion 32 (which constitutes one end of the stem 17) is aligned such that the plane of the surface 60 of the upper tier 44 is parallel with the plane of the face 36. As can be readily seen in FIG. 3(*c*)-d), the horizontal arms 57 of the cross-shaped opening 50 are somewhat smaller than the respective lower and upper vertical arms 58 and 61 thereof. These horizontal arms 57 are sized such that the rectangular-shaped face 36 of the head 34 will essentially fill the entire rectangular area defined by the horizontal arms 57 of the cross-shaped opening 50, allowing for a minimum of clearance so that the head 34 can be easily pushed completely therethrough.

Once the head 34 is pushed completely through the cross-shaped opening 50, the slots 35 just behind the head 34 are then aligned with shoulders 53 and 54. The slots 35 are sized to be slightly wider than the width of the shoulders 53 and 54, thereby allowing the male portion 33 to be moved in a direction normal to the direction it was moved when being inserted through the cross-shaped opening 50. Such motion causes the slots 35 to slide over one set of shoulders (either 53 or 54) and the head 34 thereby to become locked in the groove area (55 or 56) behind the shoulders (53 or 54).

Although the shoulders 53 and 54 and the slots 35 are shown uniform in dimension, it is contemplated to be within the scope of the invention that the shoulders 53 and 54 and slots 35 be somewhat tapered, if desired, in such a manner that movement of the slots 35 over the shoulders 53 or 54 cause the tapers to engage so that the frictional contact force between them increases as the slots 35 move over the shoulder 53 or 54. The tapers assist in prevention of accidental disengagement of the attachment member 32.

As the male portion 33 is slid toward the surface 59 of the lower vertical arm 58 of the cross-shaped opening 50, the ramp portion 39 of the locking shoulder 38 located on the tab 37 is simultaneously slid along the surface 60 of the upper tier 44 of the base unit 11. Continued sliding of the stem 17 in a direction parallel to surface 60 causes the ramp 39 to push the tab 37 away from the surface 60.

When the stem 17 is finally moved a sufficient distance that the male portion 33 of the attachment member 32 contacts the surface 59 of the lower vertical arm 58 of the cross-shaped opening 50, the locking shoulder 38 no longer contacts the outer surface 60 of the upper tier 44. The tab 37 therefore will move back into its original non-flexed position, and push the locking shoulder 38 into the upper vertical arm 61 of the cross-shaped opening 50. The locking surface 40 of the locking shoulder 38 thereby contact the upper surface 62 of the upper vertical arm 61 of the cross-shaped opening 50. Once in this position, the male and female portions (33 and 41 respectively) of the attachment member 32 cannot be disengaged unless the locking shoulder 38 is first disengaged from its contact with the upper surface 62 of the upper vertical arm 61 of the cross-shaped opening 50.

When the locking shoulder 38 is in its locked position, the tab 37 extends slightly beyond the top edge 63 of the upper tier 44. When it is desired to disengage the attachment member 32, the user merely grips the upper end 64 of the tab 37 to pull it in a direction away from the cross-shaped opening 50, thereby disengaging the locking shoulder 38 and allowing the stem 17 to be pushed in an upward direction to disengage the slots 35 of the male portion 33 from the shoulders 53 or 54 of the female portion 41 of the attachment member 32. The stem 17 can then be pulled away from the base unit 11 to remove the head 34 of the male portion 33 from the horizontal arms 57 of the cross-shaped opening 50 to completely disengage the male and female portions (33 and 41 respectively) of the attachment member 32.

If desired, an alternate embodiment of the attachment member may also include a catch 65 which is contiguously formed with the face 36 of the head 34 and extends therebeyond beyond in a direction opposite and parallel to the tab 37. When the male and female portions (33 and 41 respectively) of the attachment member 32 are connected and locked in their connected position, the catch 65 becomes engaged in the secondary slot 66 located in and forming a part of the opening 52 of the lower tier 42 of the base unit 11.

As can be readily seen, the design of the female portion 41 of the attachment member 32 allows the base unit 11 to be oriented in either of two positions, while still allowing the holding unit 12 to be attached thereto in its proper orientation. For example, the base unit 11 may be oriented as shown in FIG. 5, or may be rotated a full 180 degrees from this shown position. Since the female portion 41 of the attachment member 32 is a mirror image of itself across any plane which includes the central axis 68 and which passes through the center of the horizontal arms 57 and a vertical arms 58 and 61, a rotation of the base unit 11 of 180 degrees has no effect on the attachment of the holding unit 12 thereto.

Because of this unique feature, a base unit 11 may be integrally formed with a second base unit 11 in the manner as shown in FIG. 3(*f*), and the two units may be mounted to a vertical surface and used in conjunction in their integrally formed configuration. Even though one base unit 11 is effectively oriented 180 degrees from the other base unit 11, both base units 11 can nevertheless function to attach holding units 12 in an identical manner.

The dual directional design of the base unit 11 allows for easier manufacturing thereof. Also, since a single base unit 1 can be oriented with the extended portion of its lower tier 42 in an up or down position, it is easily mountable to a wall or window surface even when space is limited.

It is also intended to be within the scope of the present invention that the female portion 41 of the attachment member 32 be oriented at any angle relative to the base unit 11 (such as at a 90 degree angle from its orientation shown in the drawings of the preferred embodiment herein) so as to allow an elongated object to be held in the holding unit 12 at any angle from completely horizontal to completely vertical if desired.

Figure 4A:
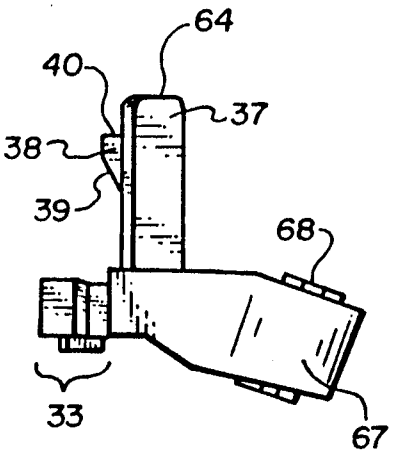
FIG. 4(*a*) is a perspective view of an alternative embodiment of the stem unit of the present invention.
Figure 4C:
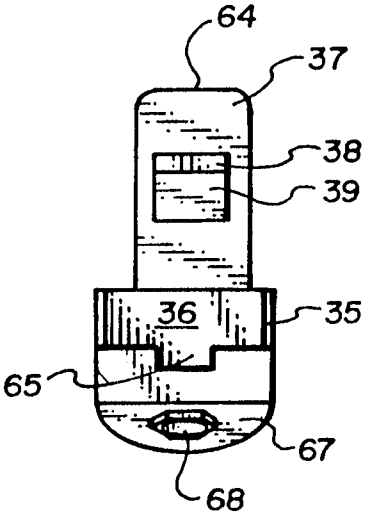
Figure 4B:
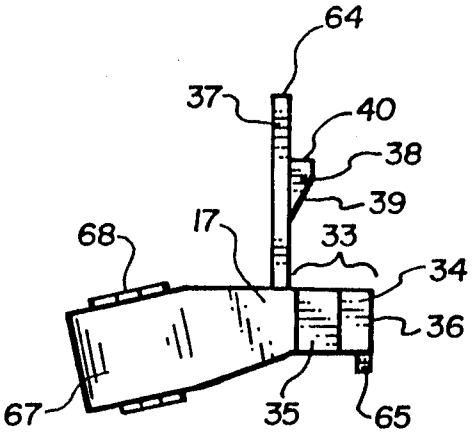

A second preferred embodiment of the holding unit 12 is shown in FIGS. 4(*a–c*). In this embodiment, the stem 17, male portion 33 of the attachment member 32 and the tab 37 and locking shoulder 38 are identical to that described above. However, the opposite end of the stem is integrally formed with a platform 67 of generally cylindrical shape. The platform 67 has located in the center thereof a fitting 68 such as a threaded opening or the like, to which a holding unit 12 may be adjustably attached.

Figure 6:
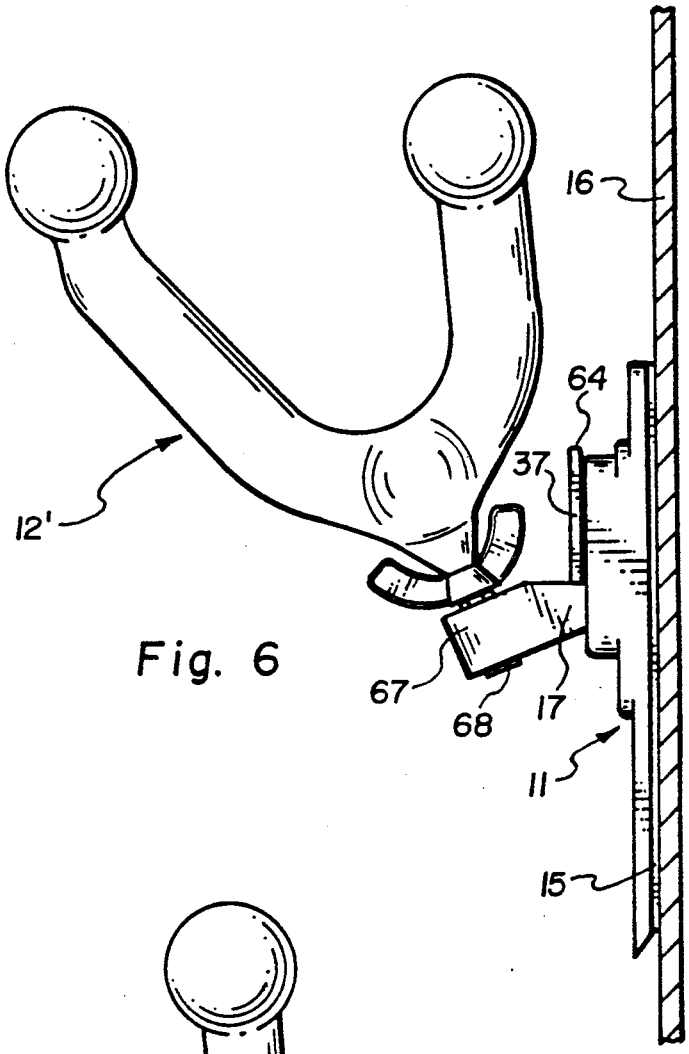
FIG. 6 is a side view of a second embodiment of the present invention.
Figure 7:
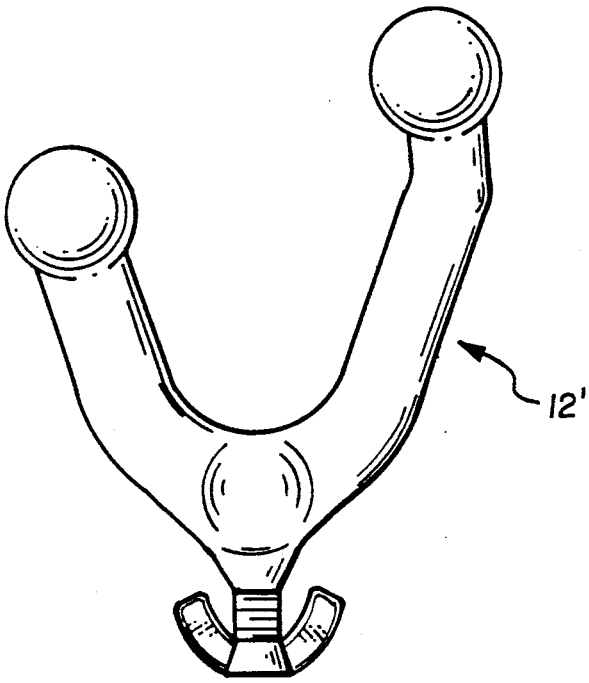
Fig. 7 (PRIOR ART)
FIG. 7 is a front view of a prior art holding unit.

In FIG. 6, an embodiment of a sub assembly 10 of the invention including the stem 17 and platform 67 is shown, with a holding unit 12′ attached thereto. This holding unit 12′, shown more specifically in FIG. 7, is described in applicants U.S. Pat. No. 4,607,772 which is incorporated herein by reference.

As is evident from the foregoing disclosure, the base unit 11, or a plurality of base units 11, may be attached to a vertical surface such as a wall 13 (as shown in FIG. 1) or a window 16 (as shown in FIG. 6) in any relative orientation desired to suit the purposes of the user and to accommodate existing space limitations. The base units 11 may be oriented in an "up-or-down" position depending on the existing space conditions and the user's needs, with no effect on the functioning of the attachment member 32.

Once the base units 11 are in place, the user may then choose a desired holding unit 12 or 12′, the holding unit being either formed integrally with the stem 17 or the stem 17 being formed integral with a platform 67 which can accept the holding unit 12 or 12′, and the male and female portions (33 and 41 respectively) of the attachment member 32 can be locked in interengagement. The user can then insert the object(s) to be stored into the holding units 12 or 12′ and, if provided, the hold down 31 can be secured thereover.

If the user at any time has no need of a particular holding unit 12 or 12′, the unit may either be disengaged from the platform 67, or the male portion 33 of the attachment member 32 may be disengaged and removed from the base unit 11. Thus, when not in use, only the base unit 11 need remain attached to the vertical surface 13 or 16.

It is to be understood that the above described arrangements are only illustrative of the application of the principles of the present invention. Numerous modifications and alternative arrangements may be derived by those skilled in the art without departing from the spirit and scope of the present invention and the appended claims are intended to cover such modifications and arrangements.

We claim:

1. A utility carrier for attachment to a vertical surface for carrying elongated objects, said carrier comprising:

a base unit adapted for rigid attachment to the vertical surface, a stem means having a first end and a second end, an attachment means having a first portion formed integrally with said base unit and forming a cross-shaped opening, said opening defining a plurality of shoulders, and a second portion formed integrally with said first end of said stem means and including a head and a plurality of slots located adjacent said head, of said stem means and including a head and a plurality of slots located adjacent said head, holding unit means for securely engaging the elongated object to be carried, said holding unit means being adapted for rigid attachment to said second end of said stem means, and locking means attached to said stem means between said first end and said second end thereof, whereby said first and second attachment portions are interconnectable by inserting said head through said cross-shaped opening and engaging at least two of said plurality of shoulders into said slots to rigidly attach said base unit to said stem means, and whereby said locking means engages said cross-shaped opening to lock said first and second attachment portions in their interconnected position.

2. A utility carrier as in claim 1, wherein the locking means comprises a tab which has included thereon a locking shoulder which forms a locking surface and a ramp, the locking surface extending from the tab in the direction of the second portion of the attachment means.

3. A utility carrier as in claim 2, wherein the first portion of said attachment means includes upper and lower vertical arms, the upper vertical arm including an upper surface and the lower vertical arm including a bottom surface, the locking surface of the locking means contacting the upper surface of the upper vertical arm and the second portion of the attachment means contacting the bottom surface of the lower vertical arm in their interconnected position.

4. A utility carrier according to claim 1 wherein said holding unit means includes a U-shaped channel in which the elongated shaped object to be carried is insertable.

5. A utility carrier according to claim 4 wherein said U-shaped channel includes a first arm and a second arm, said first and second arms having interior and exterior surfaces, said interior surface said first and second arm forming a portion of said U-shaped opening into which an elongated object for carrying is to be inserted, the exterior surface of said first arm including a plurality of notches and the exterior surface of said second arm including an anchoring means, and hold down means attached to the exterior surface of said second arm by said anchor means, said hold down means being formed of a stretchable material which can be stretched from said second arm to said first arm and attached to said notches.

6. A utility carrier as defined in claim 5 further including padding means located on said interior surface of said U-shaped channel.

7. A utility carrier as defined in claim 1 wherein said stem means includes a platform rigidly attached to said second end thereof, said platform being adapted for rigid attachment to said holding unit means.

8. A utility carrier as defined in claim 1 wherein said first attachment portion defines an upper half and a lower half, said upper half and said lower half being mirror images of each other.

9. A utility carrier as defined in claim 5 wherein said base unit is rectangular in shape and defines a longitudinal axis, and said first attachment portion also defines a longitudinal axis, said longitudinal axis of said first attachment portion being oriented at an angle from 0 to ninety degrees from said longitudinal axis from said base unit.

* * * * *